US011952192B2

(12) United States Patent
Kelly

(10) Patent No.: US 11,952,192 B2
(45) Date of Patent: Apr. 9, 2024

(54) STANDING POUCH WITH CAP ON FOLDED EDGE

(71) Applicant: Robert C. Kelly, Houston, TX (US)

(72) Inventor: Robert C. Kelly, Houston, TX (US)

( * ) Notice: Subject to any disclaimer, the term of this patent is extended or adjusted under 35 U.S.C. 154(b) by 0 days.

(21) Appl. No.: 16/143,099

(22) Filed: Sep. 26, 2018

(65) Prior Publication Data

US 2020/0095042 A1 Mar. 26, 2020

(51) Int. Cl.
*B65D 75/00* (2006.01)
*B65B 9/20* (2012.01)
*B65D 75/56* (2006.01)

(52) U.S. Cl.
CPC ..... *B65D 75/008* (2013.01); *B65B 9/20* (2013.01); *B65D 75/56* (2013.01); *B65D 2575/586* (2013.01)

(58) Field of Classification Search
CPC ..... B65D 75/008; B65D 75/056; B65D 2575/586; B65B 9/20
USPC ..... 383/6
See application file for complete search history.

(56) References Cited

U.S. PATENT DOCUMENTS 3,225,967 A * 12/1965 Heimgartner ..... B65D 83/62 222/183
3,435,736 A * 4/1969 Erwin ..... B65D 31/08 493/194
3,663,239 A * 5/1972 Rowe ..... B65D 75/5805 426/113
4,779,736 A * 10/1988 Geasland ..... B65D 25/38 206/524.8
5,307,955 A * 5/1994 Viegas ..... B65D 47/2031 222/107
5,540,358 A * 7/1996 Wiles ..... B65D 75/5877 222/107
6,029,810 A * 2/2000 Chen ..... A47G 25/54 206/287
6,581,357 B1 * 6/2003 Lindenberger ..... B65B 61/186 53/550
6,783,277 B2 * 8/2004 Edwards ..... B31B 70/00 383/119
8,806,843 B2 * 8/2014 Chang ..... B65D 75/008 53/484
9,932,161 B2 * 4/2018 Ohmae ..... B31B 70/844
10,540,840 B2 * 1/2020 Edwards ..... G07F 13/10
10,940,657 B2 * 3/2021 Nii ..... B65B 43/52
11,148,387 B2 * 10/2021 Takano ..... B65D 75/52
2002/0110291 A1 * 8/2002 Edwards ..... B65D 31/005 383/104
2002/0141663 A1 * 10/2002 Edwards ..... B65D 33/065 383/104
2003/0059130 A1 * 3/2003 Yoneyama ..... B65D 77/065 383/906
2005/0053314 A1 * 3/2005 Ikeda ..... B29C 45/14475 383/104
2006/0285775 A1 * 12/2006 Fukuizumi ..... B65D 75/42 383/37

(Continued)

*Primary Examiner* — Peter N Helvey
(74) *Attorney, Agent, or Firm* — Hogan Lovells US LLP

(57) ABSTRACT

A flexible standing pouch made from a single sheet of packaging material having a fitment with a flat flange for mounting cap or dispensing device sealed onto a folded edge forming the top of the package, seams on each side and a bottom formed by turning the opposing corners of the bottom of the flat package downward, compressing them and turning them inward to form a flat bottom.

12 Claims, 8 Drawing Sheets

(56) References Cited

U.S. PATENT DOCUMENTS

| | | | | |
|---|---|---|---|---|
| 2009/0008417 | A1* | 1/2009 | Gunn | B65D 75/5877 383/105 |
| 2009/0065505 | A1* | 3/2009 | Lai | B65D 5/324 220/288 |
| 2010/0215294 | A1* | 8/2010 | Berman | A61J 11/0095 383/202 |
| 2011/0083402 | A1* | 4/2011 | Walker | B65B 9/20 53/451 |
| 2012/0195528 | A1* | 8/2012 | Font Lletche | B65D 75/008 383/42 |
| 2013/0084028 | A1* | 4/2013 | Cross | B65D 75/008 383/33 |
| 2013/0186899 | A1* | 7/2013 | Barron | B65D 47/2018 220/288 |
| 2015/0274392 | A1* | 10/2015 | Pease | B65D 75/5877 383/10 |
| 2016/0009455 | A1* | 1/2016 | Nakano | B65D 75/5877 383/107 |
| 2016/0229615 | A1* | 8/2016 | Nabeta | B65D 75/5883 |
| 2017/0197771 | A1* | 7/2017 | Smith | B65D 75/008 |
| 2017/0208797 | A1* | 7/2017 | Murray | A01N 25/22 |
| 2018/0071991 | A1* | 3/2018 | Wilkes | B29C 66/81411 |
| 2018/0086515 | A1* | 3/2018 | Ma | B65D 25/44 |
| 2018/0208337 | A1* | 7/2018 | Watanabe | B65D 75/5877 |
| 2018/0244418 | A1* | 8/2018 | Wilkes | B65B 61/186 |
| 2018/0360415 | A1* | 12/2018 | Dohm | A61B 8/4281 |
| 2019/0152669 | A1* | 5/2019 | Tiwari | B65D 75/008 |
| 2019/0185213 | A1* | 6/2019 | Kodama | B65D 33/02 |
| 2019/0241339 | A1* | 8/2019 | Sako | B65D 75/00 |

* cited by examiner

STANDING POUCH WITH CAP ON FOLDED EDGE

FIELD

The disclosure relates generally to flexible packaging containers. The disclosure relates specifically to sealed, standing, flexible packaging containers.

BACKGROUND

Standup bags are used for containing fluids and fine materials. The ability to stand is advantageous because standing prevents loss of contents after the bag is opened. The ability to stand can be achieved by incorporating a base into one side of the bag. An advantage of flexible packaging is that bags cost less than bottles and cartons. Standup bags came into wide use due to their shelf presence. The package is regarded as displaying well on the store shelf and the pantry shelf.

Present designs for standup bags require sophisticated and expensive technology to produce. This is because the base of such designs is formed by sealing multiple separate sheets of packaging material together or by folding a single sheet in a manner that requires multiple, complicated seals along the base.

It would be advantageous to create a standing package that is simpler in design and less expensive to produce than current standup bags.

SUMMARY

An embodiment of the disclosure is a standing pouch comprising sealed packaging material having a first sealed side, second sealed side, third sealed side, and one folded side; and a cap present on the folded side; wherein one of the first sealed side, second sealed side, and third sealed side comprises compressed corners folded inward to form a base. In an embodiment, the folded side comprises a hole adjacent the cap. In an embodiment, the sealed side comprising the base is opposite of the folded side. In an embodiment, the sealed side comprising the base is adjacent to the folded side. In an embodiment, the folded side does not comprise a hole adjacent the cap prior to the cap on the standing pouch being opened. In an embodiment, the cap is on the top of the pouch. In an embodiment, the cap is on the side of the pouch. In an embodiment, the standing pouch further comprises a handle. In an embodiment, the volume of the pouch is between about 50 milliliters and 10 liters. In an embodiment, the volume of the pouch is about 1 liter. In an embodiment, the packaging material is one or more layers selected from the group consisting of polymers, acrylonitrile, paper, aluminum foil, nonwovens, metallized materials, bioplastics and other materials suitable for making pouches.

An embodiment of the disclosure is a method of producing a three-side seal, standing pouch comprising: pulling a single continuous sheet of packaging material through a forming collar and folding the material into a front and back surface; sealing the folded material along the edge; sealing the folded material along a third edge; and sealing the folded material along the remaining open edge. In an embodiment, the method further comprises compressing two adjacent corners and folding them against the bottom of the pouch. In an embodiment, the method further comprises applying heat to the corners during compression. In an embodiment, the method further comprises applying heat to set the corners in place against the bottom of the pouch. In an embodiment, the method further comprises applying glue to set the corners in place against the bottom of the pouch. In an embodiment, the method further comprises punching a hole into the said sheet of material and sealing the flange of a cap fitment into the hole. In an embodiment, sealing is accomplished by heat or ultrasonic sealing. In an embodiment, the standing pouch is produced using a vertical form fill seal (VFFS) machine. In an embodiment, the method further comprises filling the standing pouch with a desired substance. In an embodiment, the volume of the produced three-side seal, standing pouch is about 50 milliliters to about 10 liters. In an embodiment, the volume of the produced three-side seal, standing pouch is about 1 liter. In an embodiment, the packaging material is selected from the group consisting of polymer, paper, acrylonitrile, acrylonitrile plastic, films, and foils.

An embodiment of the disclosure is a three-side seal pouch produced and filled by the method above.

An embodiment of the disclosure is an apparatus for production of a standing pouch comprising a vertical form fill seal machine; guide rollers adjacent to the vertical form fill seal machine; a forming collar adjacent to the guide rollers; a conveyor in proximity to the forming collar; a pocket present on a conveyor; and movable dies present within the pocket.

In an embodiment, the packaging material is selected from the group consisting of one or more of polymer, acrylonitrile, acrylonitrile plastic, films, paper, bioplastic, and foils. In an embodiment, the foils are aluminum. In an embodiment, the films are plastic. In an embodiment, the plastic film is produced from a synthetic resin. In an embodiment, the synthetic resin is polyethylene. In an embodiment, the polymer is selected from the group consisting of at least one of polychlorotrifluoroethylene (PCTFE) polymer, ethylene-ethyl acrylate (EEA), ethylene-methyl acrylate (EMAC), ethylene-vinyl acetate (EVA), and ethylene-vinyl alcohol (EVOH). In an embodiment, the packaging material is selected from high density polyethylene (HDPE), medium density polyethylene (MDPE), low density polyethylene (LDPE), and linear low-density polyethylene (LLDPE). In an embodiment, the packaging material is selected from the group consisting of an oriented polypropylene (OPP) film, polyethylene terephthalate (PET) film, polypropylene (PP) film, metalized OPP film, metalized PET film, and polyvinylidene chloride (PVDC). In an embodiment, the packaging material is polyolefin.

An embodiment of the disclosure is a three-side seal, standing pouch produced and filled with a desired substance.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

An embodiment of the disclosure is a standing pouch comprising a flat sheet of packaging material folded in its center forming a package wherein three sides are sealed and a cap is applied on the folded side; wherein the sealed side opposite the folded side becomes a flat bottom after compressing the corners and folding them inward on which the package will stand with the cap on the top.

In an embodiment in which one side adjacent to the folded side on which the cap is applied, the corners are compressed and folded inward to form a flat bottom on which the package will stand with the cap on the side of the package.

In an embodiment in which one side adjacent to the folded side on which the cap is applied, the corners are compressed and folded inward to form a flat bottom on which the package will stand with the cap on the side of the package. The other side adjacent to the folded side is extended allowing space in which one or more holes are punched to form a means to inserting fingers to facilitate carrying the package.

Figure 1:
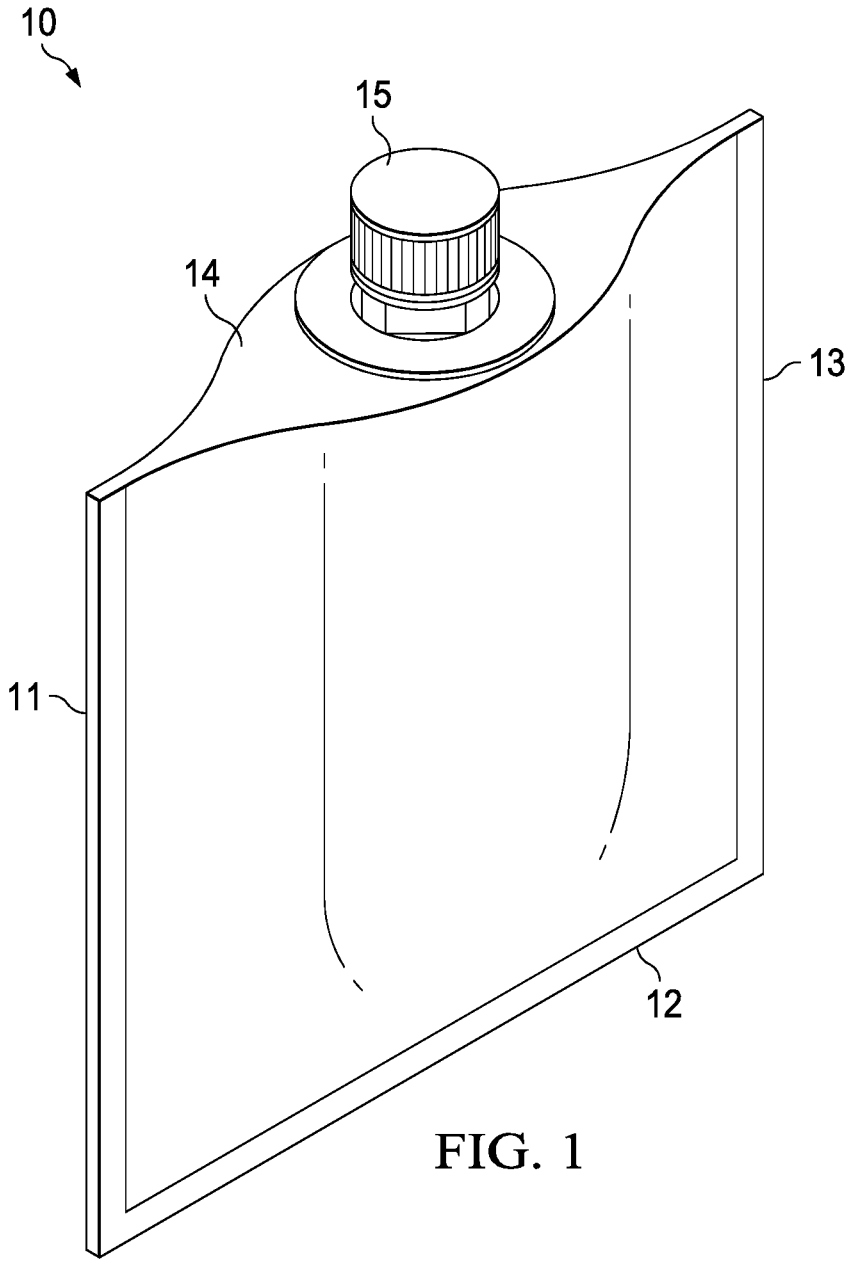
FIG. 1 depicts a three-side seal pouch with cap.

An embodiment of the disclosure is a method of producing a three-side seal, standing pouch. Production of the standing pouch begins by folding a single sheet of packaging material evenly so that the edges opposite the fold align. The packaging material is then sealed along each of the three open edges 11, 12, and 13 opposite the folded edge 14. This results in the formation of a three-side seal pouch 10 as shown in FIG. 1.

Figure 2:
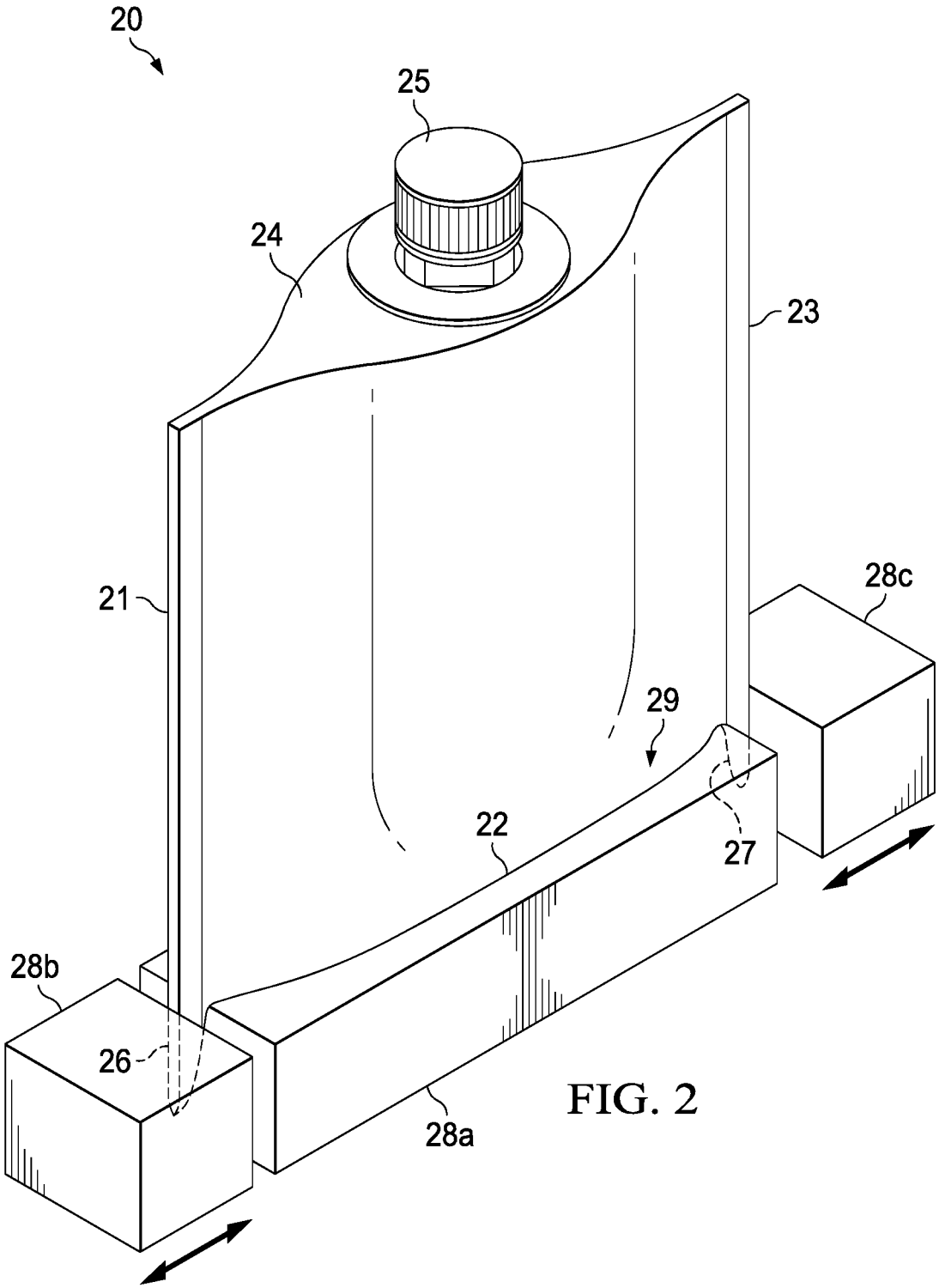
FIG. 2 depicts the compression of two corners of the three-side seal pouch with cap.

FIG. 2 depicts production of a three-side seal standing pouch. The packaging material is then sealed along each of the three open edges to form a first sealed side 21, a second sealed side 22, a third sealed side 23, the first sealed side 21 and the third sealed side 23 adjoin the folded side 24; the second sealed side 22 is opposite the folded side 24; the first sealed side 21 and the second sealed side 22 form a first corner 26, the second sealed side 22 and the third sealed side 23 form a second corner 27. The base 29 of the standing pouch 20 is created by manipulating corners 26 and 27 opposite the folded side 24 of the three-side seal pouch. First, corners 26 and 27 are compressed into a flat triangular shape. In an embodiment, this can be accomplished by mechanical means using compression dies 28*a*, 28*b*, and 28*c*, as shown in FIG. 2. The compressed corners are then folded inward along the bottom sealed side 22 to form the base 29 of the standing pouch. Heat or glue may be applied to the corners during compression and folding to facilitate formation of the standing pouch base 29.

Figure 3A:
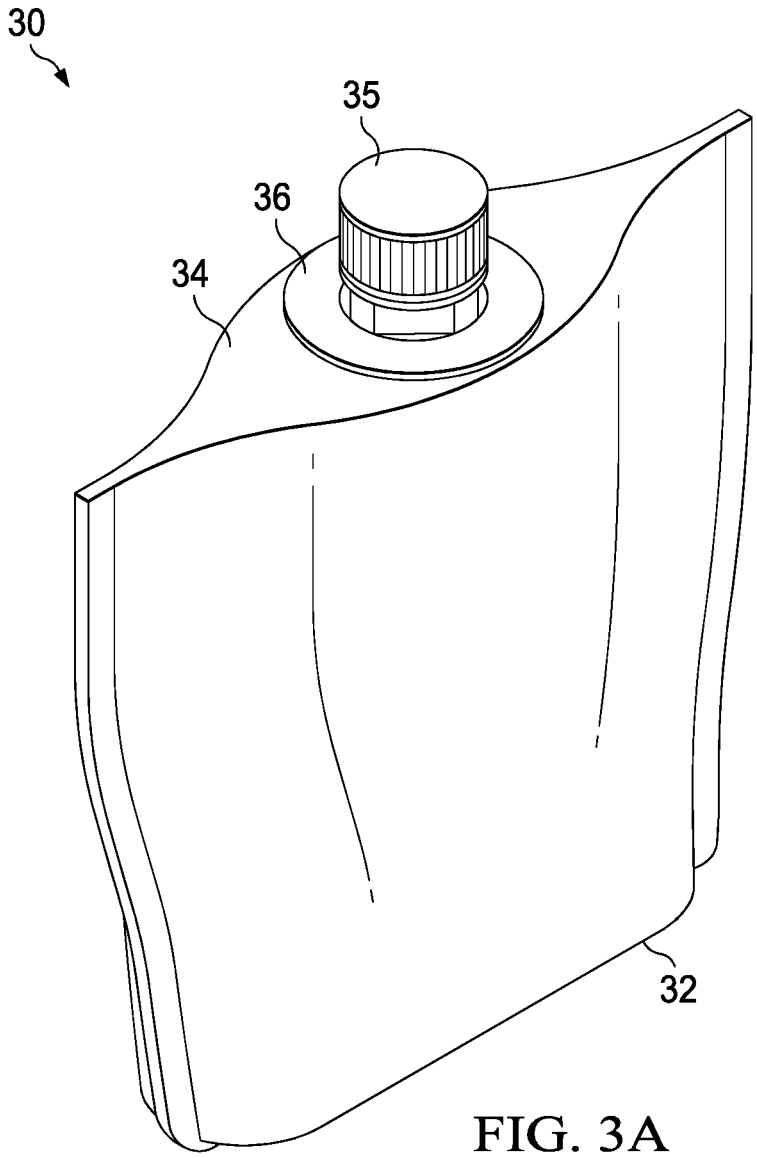
FIG. 3A depicts the front surface of a standing pouch with cap after formation of the base.
Figure 3B:
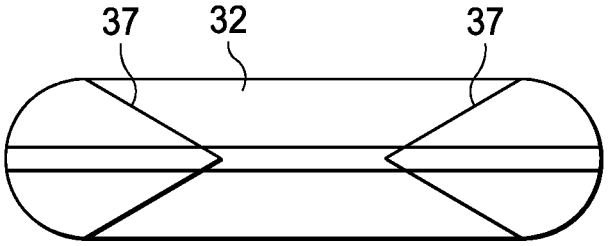
FIG. 3B depicts the bottom surface of a standing pouch with cap after formation of the base.

The three-side seal, standing pouch produced from the above method is shown in FIG. 3A and FIG. 3B. FIG. 3B depicts the compressed corners 37 flat against the bottom edge 32 of the pouch.

Figure 4A:
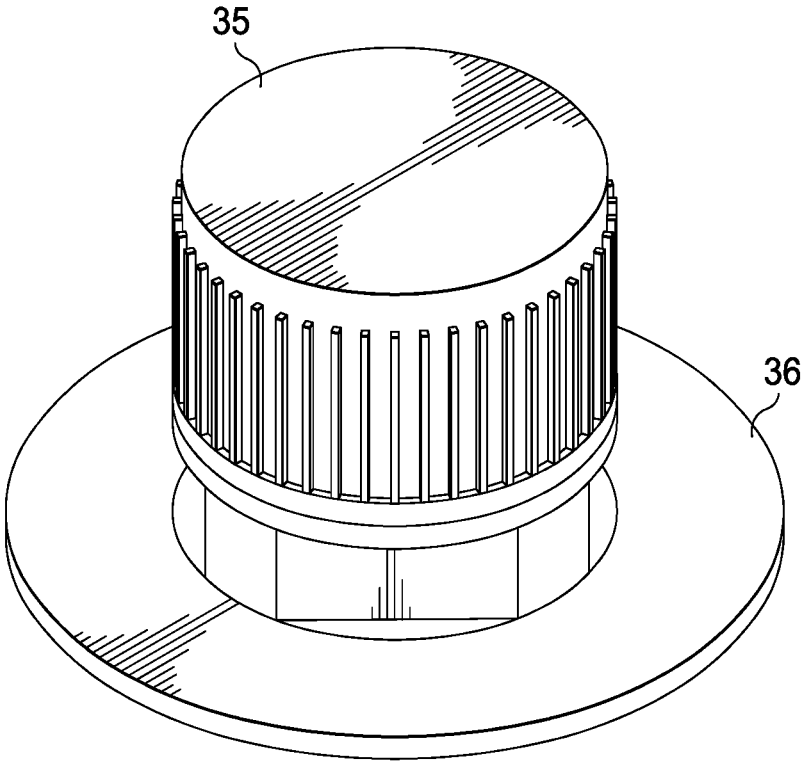
FIG. 4A depicts a cap fitment with a flat flange base utilized in an embodiment of the present disclosure.
Figure 4B:
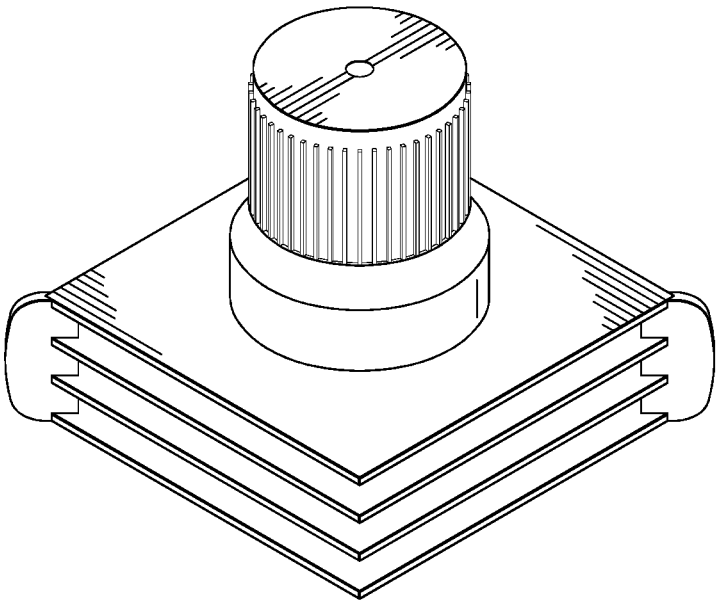
FIG. 4B depicts cap fitments not utilized in an embodiment of the present disclosure.

In an embodiment, a cap fitment 35 is sealed into the folded edge of the three-side seal, standing pouch. FIG. 3A. The flange 36, on which the cap fitment is mounted, has a flat surface that is sealed to the flat web of packaging material 34. FIG. 3A. This type of cap (FIG. 4A) fitment requires less precision and provides higher sealing reliability than sealing with the compound curves of the "canoe" shaped fitments (FIG. 4B) utilized in the present technology. Canoe shaped fitments (FIG. 4B) require the fitment to be sealed to the sheets on each side at the same time that the two sheets are sealed to one another on either side of the fitment. Each of these processes requires different pressures and temperatures, making sealing difficult.

In an embodiment, the three-side seal, standing pouches with caps are produced using a vertical form fill seal (VFFS) machine. A VFFS machine is capable of making three side seal pouches that are completely sealed prior to formation of the base. More sophisticated and expensive technology, for example horizontal form fill seal (HFFS) machines, are not required because the standing pouch is produced from a single sheet of packaging material and does not require complex sealing patterns to form the base.

In an embodiment, the three-side seal package is filled during production with a desired substance. In an embodiment, the package is filled with fluids or particulate materials. In an embodiment, the package will contain oils, sauces, or condiments. In an embodiment, the package will contain a fine material. In an embodiment, the package will contain any material that is capable of being poured from the package.

In an embodiment, sealing is accomplished by heat or ultrasonic sealing.

In an embodiment, the three-side seal, standing pouches are produced containing a volume in the range of about 50 milliliters to about 10 liters. In an embodiment, the volume of the pouch is about 4 liters. In an embodiment, the volume of the pouch is about 1 liter.

In an embodiment, the three-side seal, standing pouches are produced from packaging materials selected from one or more of the group consisting of polymer, paper, acrylonitrile, acrylonitrile plastic, films, bioplastic, and foils. In an embodiment, the foils are aluminum. In an embodiment, the films are plastic. In an embodiment, the plastic film is produced from a synthetic resin. In an embodiment, the synthetic resin is polyethylene. In an embodiment, the polymer is selected from the group consisting of at least one of polychlorotrifluoroethylene (PCTFE) polymer, ethylene-ethyl acrylate (EEA), ethylene-methyl acrylate (EMAC), ethylene-vinyl acetate (EVA), and ethylene-vinyl alcohol (EVOH). In an embodiment, the packaging material is selected from high density polyethylene (HDPE), medium density polyethylene (MDPE), low density polyethylene (LDPE), and linear low-density polyethylene (LLDPE). In an embodiment, the packaging material is selected from the group consisting of an oriented polypropylene (OPP) film, polyethylene terephthalate (PET) film, polypropylene (PP) film, metalized OPP film, metalized PET film, and polyvinylidene chloride (PVDC). In an embodiment, the packaging material is polyolefin. In an embodiment, the material can be single ply, a coextrusion, or lamination.

Figure 5A:
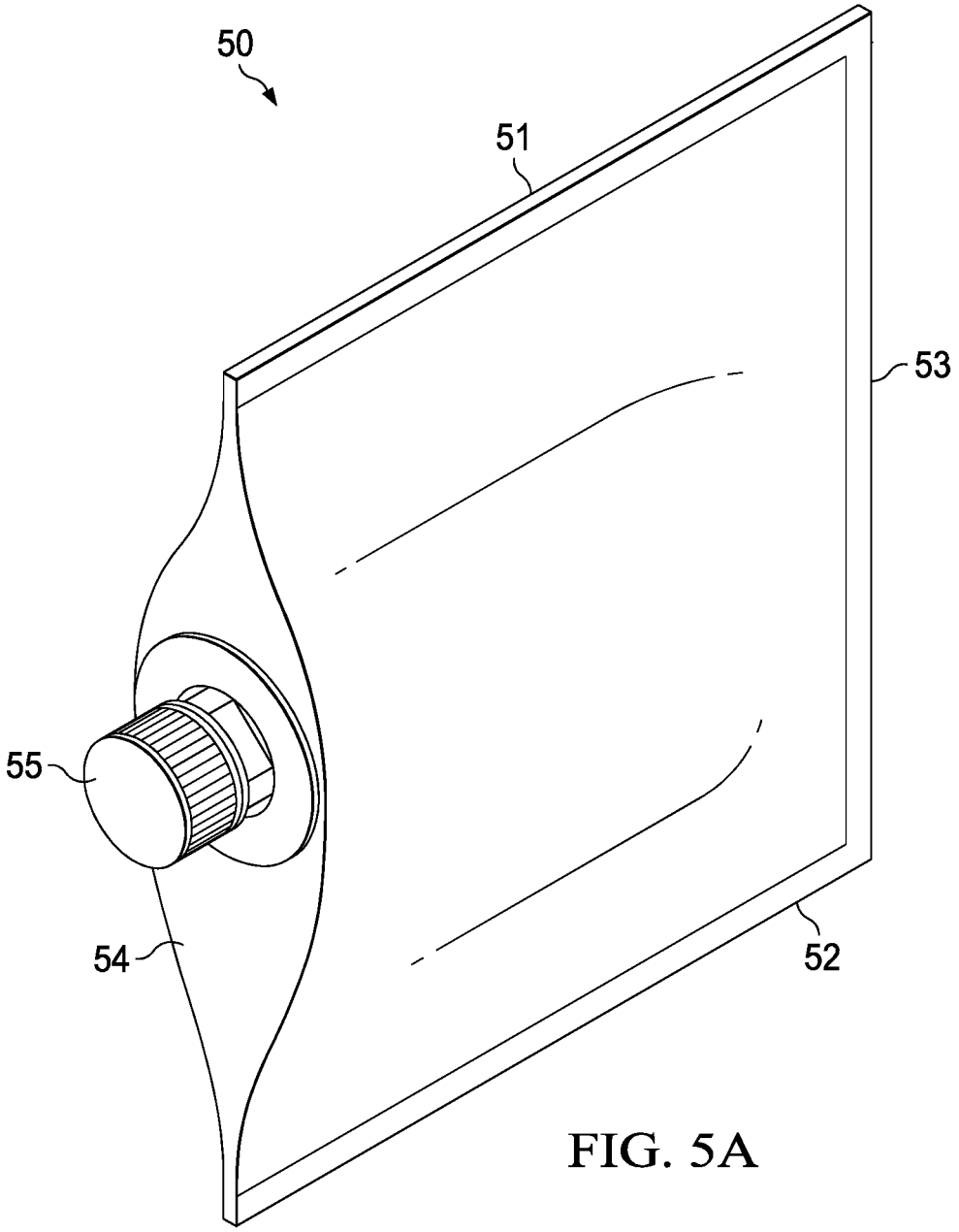
FIG. 5A depicts a three-side seal pouch with a cap on the folded edge.
Figure 5B:
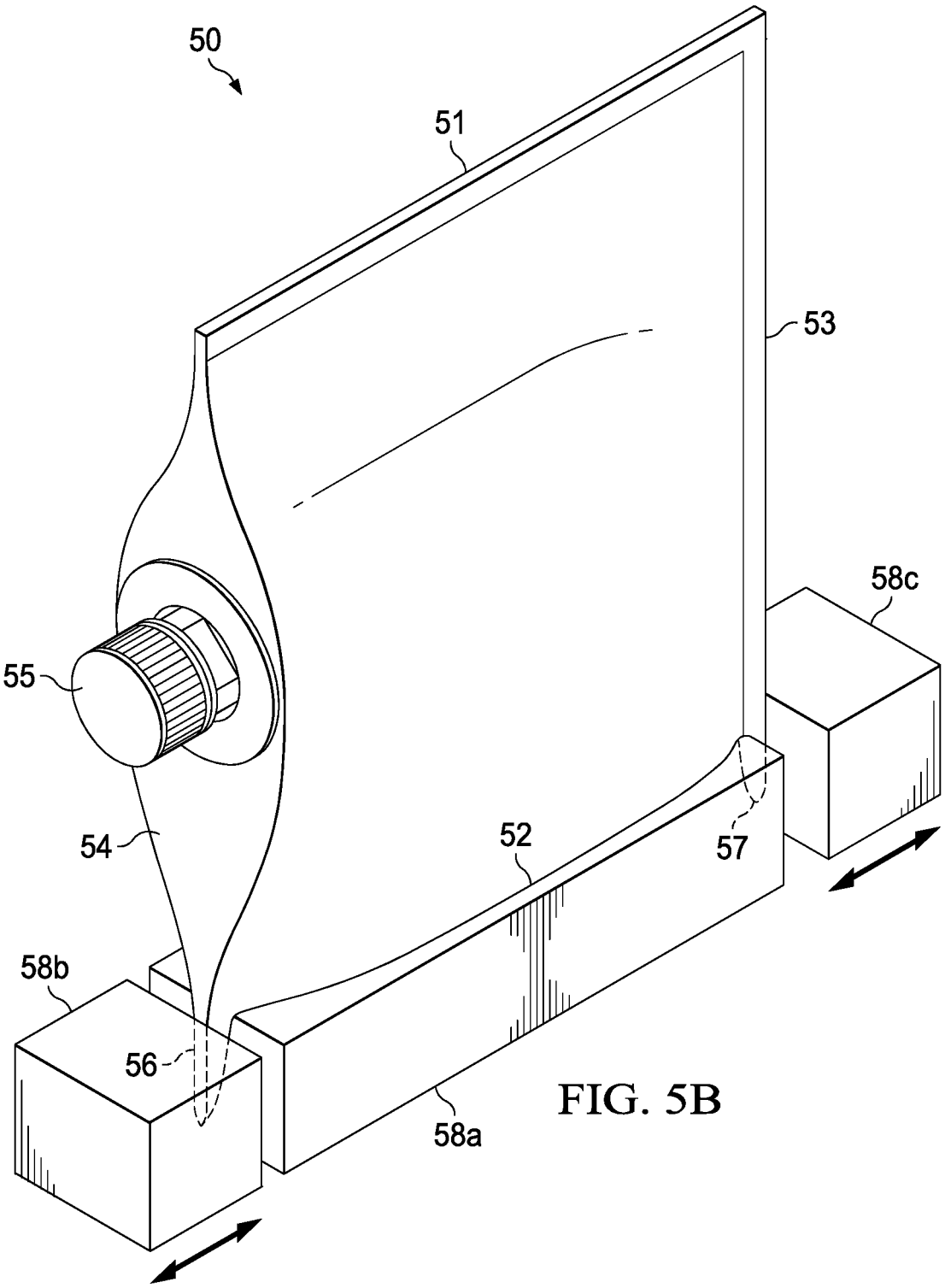
FIG. 5B depicts a three-side seal pouch on which the edges of the side adjacent to the folded edge with a cap are compressed before being folded inward to form a flat bottom on which the pouch will stand.
Figure 5C:
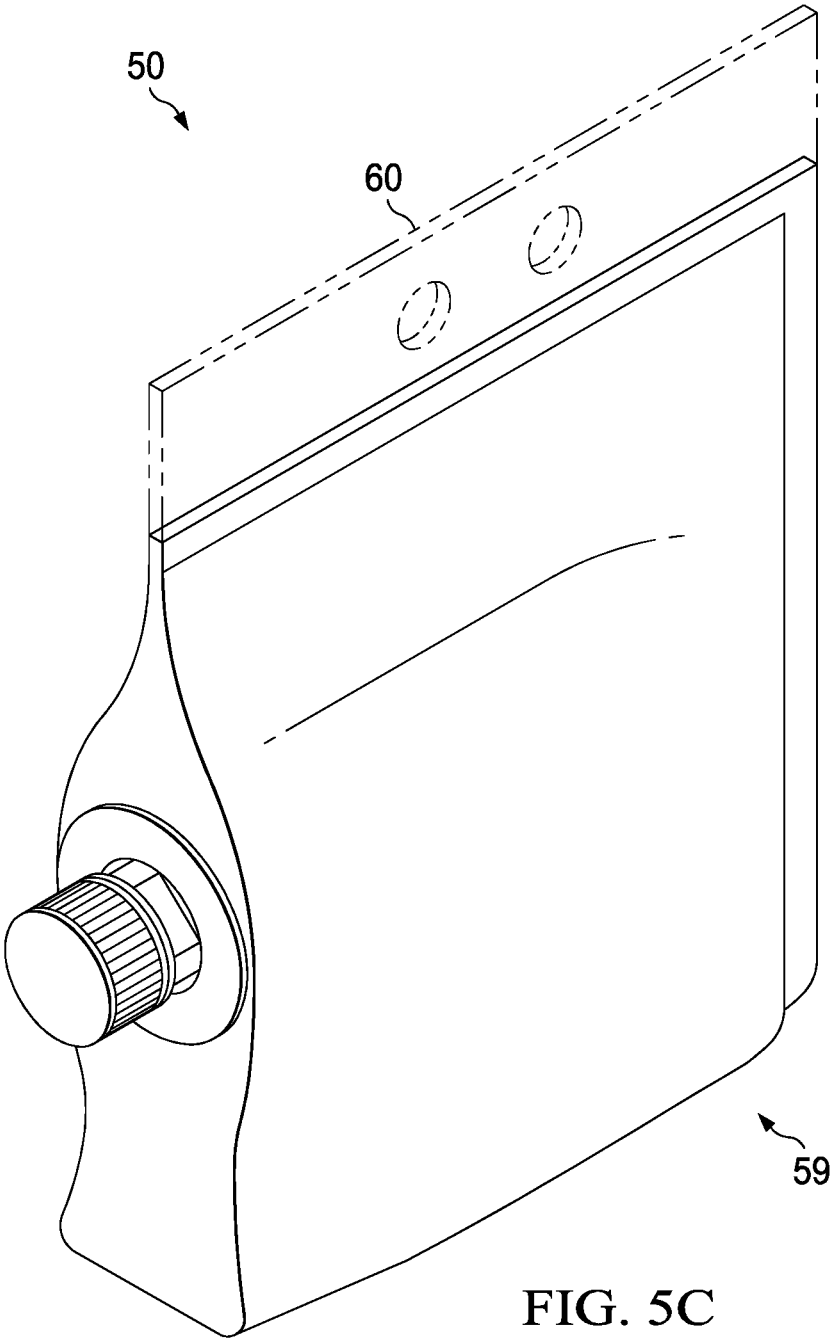
FIG. 5C depicts a standing pouch with a cap on a vertical edge with an optional handle.
Figure 6:
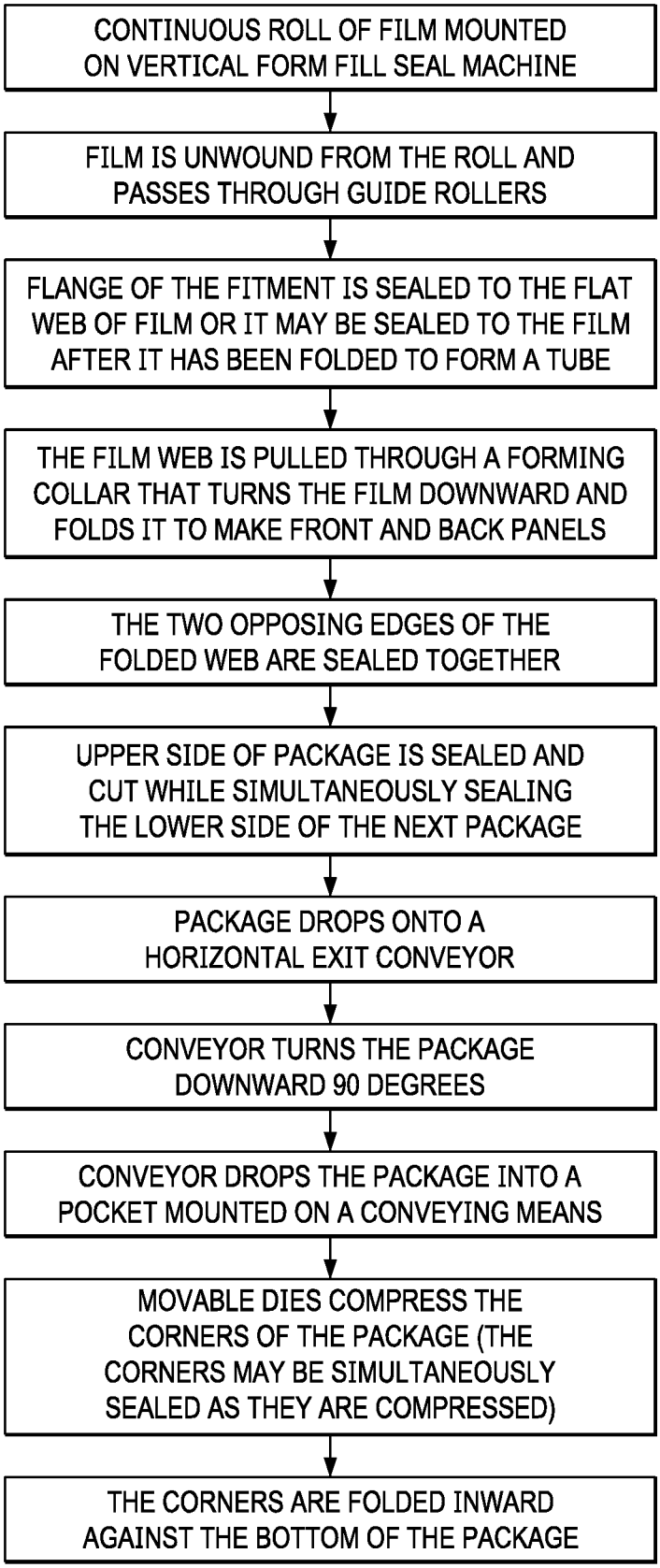
FIG. 6 depicts a process for producing three-side seal, standing pouches.

In an embodiment, the three-side seal pouch 50 is a standing pouch with the cap 55 on the side 54. FIG. 5C. An embodiment of the disclosure is a method of producing a three-side seal, standing pouch. Production of the standing pouch begins by folding a single sheet of packaging material evenly so that the edges opposite the fold align. The packaging material is then sealed along each of the three open edges 51, 52, and 53 opposite the folded edge 54. This results in the formation of a three-side seal pouch 50 as shown in FIG. 5A.

In FIG. 5C, the base 59 of the three-side seal pouch 50 is created by manipulating the corners 56 and 57 on the edge adjacent the folded edge of the three-side seal pouch. First, the corners 56 and 57 are compressed into a flat triangular shape. In an embodiment, this can be accomplished by mechanical means using compression dies 58*a*, 58*b*, and 58*c*, as shown in FIG. 5B. The compressed corners 56 and 57 are then folded inward along the bottom sealed edge 52 to form the base 59 of the standing pouch. FIG. 5C. Heat or glue may be applied to the corners during compression and folding to facilitate formation of the standing pouch base 59. In an embodiment, the pouch includes a handle 60. FIG. 5C.

In an embodiment, a process for producing three-side seal, standing pouches comprises: the continuous roll of film mounted on vertical form fill seal machine; the film is unwound from the roll and passes through guide rollers; the flange of the fitment is sealed to the flat web of film or it may be sealed to the film after it has been folded to form a tube; the film web is pulled through a forming collar that turns the film downward and folds it to make front and back panels; the two opposing edges of the folded web are sealed together; the upper side of package is sealed and cut while simultaneously sealing the lower side of the next package; the package drops onto a horizontal exit conveyor; the conveyor turns the package downward 90 degrees; the conveyor drops the package into a pocket mounted on a conveying means; the movable dies compress the corners of the package (the corners may be simultaneously sealed as they are compressed); and the corners are folded inward to form the bottom of the package.

In an embodiment, an apparatus for production of a standing pouch comprises a vertical form fill seal machine; a conveyor onto which a completed flat package is dropped; transfer of each completed package by the conveyor to a pocked mounted on a second conveying means; a bar narrower than the width of each package below each pocket onto which the completed package is dropped causing the bottom edges of the package to fold downward; movable dies present on either side of the pocket that press the downwardly folded edges against the bar to flatten them; a means of inwardly folding the flattened edges against the bottom of the package after the pocket has been moved away from the bar onto a second narrower bar; a flat plate onto which the package with folded bottom is moved.

In an embodiment of the apparatus, the moveable dies on either side of the pocket are heated to seal the insides of the bottom edges as they are flattened. In an embodiment, the flat plate onto which the package with a folded bottom is moved is heated.

EXAMPLES

Example 1: Process for Producing Three-Side Seal, Standing Pouches

A continuous roll of film mounted on the back side of a vertical form fill seal (VFFS) machine is unwound and passes through a system of guide rollers.

At the point at which the flange of the fitment is to be applied: 1) If the flange of the fitment is to be sealed to the inside of the package, then a hole through which the cap will extend will be punched out; 2) if the flange of the fitment is to be sealed to the outside of the package hole through which the product will pass, then a hole will be punched out; 3) if the fitment punches a hole in the film when the cap is first removed for access to the contents, then no hole will be punched. The flange of the fitment will be sealed to the packaging material either by heat or ultrasonic sealing.

The continuous roll of film is then pulled through a forming collar that turns the film web down vertically and folds it to make front and back panels. At this point the package to be is moving downward sideways.

The bottom of the package, now vertical, is sealed. As the film is pulled downward the upper side of a previously filled package is sealed and cut off by a horizontal seal bar that simultaneously seals the lower side of the next package as it is filled.

When the sealing jaws open the completed three side seal package is dropped onto a conveyor that conveys it horizontally out of the front of the packaging machine. When the package has cleared the front of the packaging machine the conveyor turns the package 90 degrees to a vertical orientation with the bottom of the package at the bottom and drops it into a pocket mounted on a conveying means. The pocket is one of many mounted on the conveying means one end of which discharges completed packages with pockets in a continuous path returning to receive new packages. Each pocket has front, back, and sides to constrain the package and an open bottom below which is a flat rail, the width of which is narrower than the package with flat sides at right angles to the top.

When the package is dropped into the pocket the bottom corners of the package which forms a triangular shape turn downward on each side of the rail on which the bottom of the package rests. The pocket indexes forward and moveable dies come forward against the sides of the rail to compress the corners of the packages. The moveable dies may be heated to the sealing temperature of the packaging material to seal the triangular package corners. The compression of the package corners may be repeated at additional stations as the pockets index forward.

In the positions after the corner compression stations the width of the rail is reduced to allow the corners to be folded inward against the bottom of the package. If the corners are to be sealed against the bottom hot melt glue is sprayed on the inside of the compressed corners as they move forward. The package is indexed forward and plows on each side fold the corners inward.

After the corners are folded inward against the bottom the package is indexed forward over a flat rail that allows them to set in place. If glue is not used to set the corners in place the rail is heated to set them in place.

The completed packages are discharged from the bottom folding assembly.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A standing pouch comprising a first sealed side, a second sealed side, a third sealed side, and a folded side comprising a top surface that is wider than a cap fitment at the center and narrower than the cap fitment at both ends and two folded edges;

a cap fitment;

a hole on the top surface;

a flange on which the cap fitment is mounted, wherein the flange is fitted into the hole and has a flat surface to be sealed to the top surface by heat or ultrasonic sealing;

wherein the first sealed side and the second sealed side form a first corner, the second sealed side and the third sealed side form a second corner, and each of the first corner and the second corner is compressed into a triangular shape and then folded inward along the second sealed side to form a base of the standing pouch, wherein a vertex of the triangular shape is against the second sealed side;

wherein the standing pouch is formed by folding a single sheet of a packaging material, the packaging material being sealed along the three open edges to form the first sealed side, the second sealed side, and the third sealed side; and wherein the first sealed side, second sealed side, and third sealed side comprise a single and continuous seal from an intersection of the folded side and first sealed side to an intersection of the folded side and third sealed side.

2. The standing pouch of claim 1 wherein the sealed side comprising the base is opposite the folded side.

3. The standing pouch of claim 1 wherein the sealed side comprising the base is adjacent to the folded side.

4. The standing pouch of claim 1 wherein the hole on the top surface is adjacent the cap.

5. The standing pouch of claim 4 wherein the hole adjacent the cap is punched out prior to sealing of a fitment to the top surface.

6. The standing pouch of claim 1 wherein the cap is on the top of the standing pouch.

7. The standing pouch of claim 1 wherein the cap is on the side of the standing pouch.

8. The standing pouch of claim 7 further comprising a handle.

9. The standing pouch of claim 1 wherein the volume of the pouch is between about 50 milliliters and about 10 liters.

10. The standing pouch of claim 9 wherein the volume of the pouch is about 1 liter.

11. The standing pouch of claim 1 wherein the packaging material is one or more layers selected from the group consisting of polymers, acrylonitrile, paper, aluminum foil, nonwovens, metallized materials, and bioplastic.

12. The standing pouch of claim 11 wherein the packaging material is a film.

* * * * *